US006517467B1

(12) United States Patent
Sutton et al.

(10) Patent No.: US 6,517,467 B1
(45) Date of Patent: Feb. 11, 2003

(54) SLIDE AND SUPPORT WITH GAMES OR INTERACTIVE GAME PIECES

(75) Inventors: Wesley D. Sutton, Fort Payne, AL (US); Brian K. Henry, Fort Payne, AL (US)

(73) Assignee: Playcore, Inc., Fort Payne, AL (US)

( * ) Notice: Subject to any disclaimer, the term of this patent is extended or adjusted under 35 U.S.C. 154(b) by 100 days.

(21) Appl. No.: 09/587,710

(22) Filed: Jun. 5, 2000

(51) Int. Cl.[7] ..... A63B 9/00; A63B 17/00; A63B 7/04

(52) U.S. Cl. ..... 482/35; 482/37

(58) Field of Search ..... 482/35–37; 472/116, 472/88–90, 117, 130, 126; D21/242, 818–819, 822, 826–827, 240–244; 446/227, 168; 104/69, 70

(56) References Cited

U.S. PATENT DOCUMENTS

D260,543 S * 9/1981 Ament et al. ..... D21/244

4,932,648 A * 6/1990 Ahrens ..... 272/56.5 R

OTHER PUBLICATIONS

Game Time Park & Playground Catalog, 1999, pp. 75 and 90.*

* cited by examiner

*Primary Examiner*—Michael A. Brown
*Assistant Examiner*—Lori Baker Amerson
(74) *Attorney, Agent, or Firm*—Walsh & Katz, Ltd.

(57) ABSTRACT

A support member is provided for a playground apparatus such as a sliding board fabricated of plastic or similar material. The support member includes a support such as a post and a game or interactive game pieces. The support is a post centrally disposed among the interactive game pieces or may be any similar or equivalent structure. The game pieces include three drum shaped sections rotatably joined along their axes to form a canister shaped composite piece. The drum sections are be decorated or otherwise adorned for use as game pieces. A plurality of the composite canister pieces are then be disposed about a centrally positioned support member.

4 Claims, 11 Drawing Sheets

SLIDE AND SUPPORT WITH GAMES OR INTERACTIVE GAME PIECES

FIELD OF INVENTION

This invention relates generally to a playground apparatus such as a sliding board. More specifically, this invention relates to an intermediate support for a playground sliding board, useful to reduce bending and flexing, a further objective of which is to provide additional playthings for children using the playground apparatus.

PRIOR ART

Playground apparatus, including sliding boards, are in general well known. Traditionally such sliding boards and other such apparatus were made of metal. It has now become more common to fabricate or mold such sliding boards or other playground apparatus from plastic or similar materials.

A disadvantage that may be encountered when playground apparatus such as sliding boards are fabricated from plastic or similar materials is that such material may tend to deform under the stress of ordinary usage in a playground environment. This deformation may be temporary or over time could become permanent. One reasons such apparatus fabricated from plastic or similar materials may tend to deform to a greater extent than more traditionally used metallic parts is that these newer materials tend to have a greater coefficient of elasticity. This tendency to flex and deform may grow more pronounced as the size of the slide increases.

This tendency of playground apparatus such as sliding boards to deform under normal usage may lead to various other problems, as is generally known. For example, periodic deformation may adversely affect stability of the playground apparatus. Also, constant deformation under such stress may tend to weaken the material composing the playground apparatus such as a sliding board, shortening its useful life. Also, joints of parts may be distended or stressed beyond their intended use. Weakening of the material from which the apparatus is fabricated or of the joints connecting parts of the apparatus may tend to implicate safety concerns.

One approach to preventing such deformation would be to provide additional material in the fabrication of the playground apparatus such as a sliding board. This approach would have the advantage of increasing rigidity and stability somewhat, but would result in increased cost of materials and increased weight. Any functional benefits of such an approach would only solve pre-existing problems that were impediments to the intended functionality of the product, but would not enhance the Ad product by providing new functionality. For these and other reasons this approach has not provided a satisfactory solution.

Another approach would be to provide additional ribbing or corrugation in the playground apparatus such as a sliding board. Such an approach might increase rigidity and stability somewhat, but would also increase the costs of material and the weight of the apparatus. Although the added expense and weight of material would not be as great as with a solid product, it would still be greater than in a product without such supplemental strengthening members. Also, additional ribbing may be more costly to design and fabricate. As with a solid piece, any functional benefits of such an approach would only solve preexisting problems that were impediments to intended functionality of the product, but would not enhance the product by providing new functionality. For these and other reasons, this approach has not provided a satisfactory solution.

A further disadvantage that may be encountered in a traditionally constructed playground apparatus such as a sliding board is that support members that may be used, for example, to support the upper end of the sliding board may have little padding or cushioning around the base of those supports. Because such a playground apparatus is typically used in a recreational environment for children it may occur on occasion that children would collide with such a support member.

A further aspect of a traditionally constructed playground apparatus such as a sliding board is that there may exist below the slide an area available for use that is not being used to full advantage. Such an area is particularly likely to be present in a larger sliding board at least about 6 feet tall or about 8 feet tall. Full utilization of this area may be particularly important in implementations where available space is at a premium, such as in an in-door playground in, for example, a restaurant.

OBJECTS AND ADVANTAGES OF THE INVENTION

It is an object of the present invention to overcome the aforementioned problems while providing a playground apparatus with enhanced functionality.

It is a further objective of the present invention to provide an intermediate support for a playground apparatus such as a sliding board to increase stability It is a further objective of the present invention to enhance the rigidity and stability of an playground apparatus such as a sliding board by providing an intermediate support such as a post.

It is a further objective of the present invention to enhance the rigidity and stability of an playground apparatus such as a sliding board by providing an intermediate support such as a post between the ground and the sliding board, connecting to the sliding board at an attachment point midway down the length of the sliding board.

It is a further objective of the present invention to enhance the functionality of a playground apparatus such as a sliding board with a game or interactive game pieces.

It is a further objective of the present invention to enhance the functionality of a playground apparatus such as a sliding board by providing an intermediate support such as a post with a game or interactive game pieces disposed around the support member.

It is a further objective of the present invention to make use of otherwise unused space beneath a playground apparatus such as a sliding board by providing in that space a game or interactive game pieces.

It is a further objective of the present invention to provide cushioning around a support member such as a post, so that any children colliding with such a support member in its also normal and intended use are less likely to suffer any injury.

SUMMARY OF THE INVENTION

The present invention may include a sliding board with an upper, sliding surface and a lower surface and having an upper end and a lower end. The upper end is supported off the ground relatively higher than the lower end by means of an upper end support such as a platform, a stand, a brace, or a ladder. The lower end may also be supported off the ground by a lower end support. There is also provided a support post, midway between the upper end support and the lower end support. The support post may be fixed in the ground. The upper end of the support post may fit in a receptacle on the lower surface of the slide.

The support post may therefore provide benefits such as additional support and rigidity.

There may also be attached around the support post interactive game or game pieces. Typically, these game pieces may be arrayed in three columns, each column parallel to the intermediate support post, with the intermediate support post central to the three columns and the three columns arrayed about it. The three columns may be mounted fixedly with respect to the centrally disposed intermediate support post, or may be rotatably attached to revolve about the intermediate support post. Each of the columns may further comprise a one or more game pieces, each of which may rotate on an axis substantially parallel to the intermediate support post and passing through the center of the column. The game pieces may be decorated with, for example, game markers or any convenient theme, such as, for example, planets, farm-animals, people in various uniforms, objects from nature, shapes, or colors. The game pieces not only serve to provide an additional recreational capacity, but may also serve as a buffer to cushion the central support post.

DETAILED DESCRIPTION OF THE DRAWINGS

Figure 1:
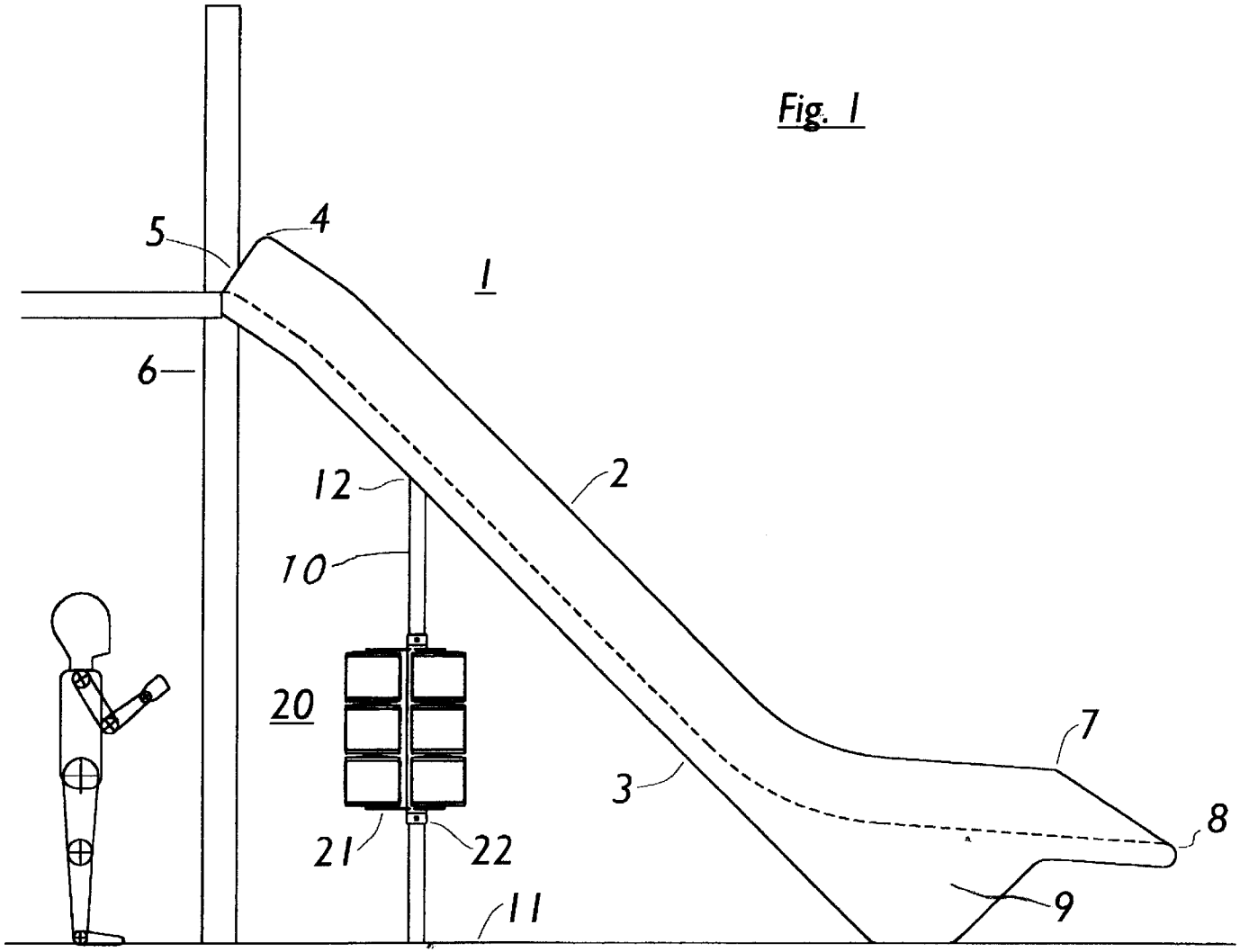
FIG. 1 is a side view of a sliding board having an intermediate support and attached interactive toys of one embodiment the present invention.

As shown in the embodiment illustration in FIG. 1, the present invention includes a central intermediate support (10), a game assembly (20) having an attachment piece (21) for attaching the game assembly to the central intermediate support (10).

A sliding board (1) or slide may include a top surface (2) on which the child slides and a bottom surface (3), which conventionally provides no functionality. A sliding board (1) may be constructed so that the sliding board (1) is angled towards the ground at an angle of, for example, about 45 degrees. In this configuration, the sliding board will have an upper end (4) comprising a entry area (5) where the user may mount the sliding board. This upper end (4) may be supported off the ground by an upper end support (6), which may be of various types, including a post or posts, a ladder or ladders, or a relatively permanently fixed deck. The sliding board (1) will also have a lower end (7) including an exit area (8). The exit area may be supported a relatively shorter distance off the ground by a lower end support (9) such as, for example, a bar, a post or posts, or a pedestal. The difference in height between the upper end support and the lower end support together with the length of the slide will determine the angle at which the slide is placed, which angle should preferably be about 45 degrees.

An embodiment of the present invention relates generally to an intermediate support (10) for a playground apparatus such as a sliding board (1). In one embodiment, the invention may include an intermediate support (10), such as a post, mounted between the ground (11) and receptacle (12) at an attachment point on the bottom surface (3) of the sliding board (1) part way down its length. This intermediate support (10) may be disposed between an upper end support (6) and a lower end support (9). Being so mounted, the intermediate support (10) is available to provide support to the sliding board (1), to enhance rigidity of the sliding board (1), and to help reduce deformation of the sliding board (1) in normal use.

As further shown in the embodiment illustration in FIG. 1, the intermediate support (10) may be a post or other similar article. The post is preferably round in cross section, but may be of any shape. More than one post or similar article may be used as the intermediate support (10). This intermediate support (10), whether a post or other structure, should be available to reduce flex in the sliding board (1), to enhance rigidity, and to reduce deformation of the sliding board (1) in normal use. This intermediate support (10) is preferably mounted centrally to the game assembly (20), but those of ordinary skill in the art will recognize that other configurations are equivalent and intended to be covered by the claims below.

Attached to the intermediate support (1) may be a game assembly (20). The game assembly (20) may be attached to the intermediate support (1) by means of an attachment piece (21) such as a propeller-shaped collar or the like. In one embodiment, the attachment piece (21) includes a central hub (22) mounted around the intermediate support (1) as a collar, and a plurality of arms or spokes (23) radiating outward from the hub (22) mounted as a collar around the intermediate support (1).

A game assembly (20) may be attached to the intermediate support (10) by means of an attachment mechanism (21). In applicant's preferred embodiment, this attachment mechanism (21) is similar in structure to the hub and spokes of a wheel. In another possible embodiment this attachment mechanism (21) may be, for example, a disk mounted around the central post. This attachment mechanism (21) may be rotatably mounted to an intermediate support (10) which may be, for example, a post, or it may be fixedly mounted to the intermediate support (10) such as a post, so as to remain stationary. If the attachment member is to be rotatably mounted to the intermediate support (10) such as post and the intermediate support (10) is not round in cross section or is not centrally disposed in the middle of game assembly (20) a more elaborate attachment mechanism (21) may be required. Such variations on the disclosed attachment mechanism (21) are considered to be within the ability of those of ordinary skill in the art to fashion in light of the disclosure herein.

In an embodiment of the invention, game pieces (25) may be attached to the attachment mechanism (21), which is in turn attached to the intermediate support (10). The game pieces (25) may be, for example, canister-shaped appendages (25) including three rotatable drum sectional pieces (26). A first drum sectional piece (26) may be rotatably attached along its axis to the attachment mechanism (21). A second drum sectional piece (26) may be rotatably attached along its axis to the first drum sectional piece (26) along its axis. A third drum sectional piece (26) may be rotatably attached along its axis to the second drum sectional piece (26) along its axis. Each of these said three drum sectional pieces (26) may be the same in cross section, or they may differ in cross section. In particular, these game pieces (25) and drum sectional pieces (26) may be flat with pictures or other graphics on both a first and a second surface. These game pieces (25) and drum sectional pieces (26) may be triangular in cross-section, with pictures on each of three external surfaces. It will be readily apparent that these game pieces (25) and drum sectional pieces (26) may be of other shapes in their cross sections. In accord with the present invention, in a preferred embodiment these game pieces and drum sectional pieces (26) may be elliptical in cross section.

The sliding board (1), in one embodiment, is described in more detail below. The sliding board (1) is preferably rotationally molded as one piece with no seams or gaps using double-wall construction. Double-wall construction allows users smoother and more comfortable exit transitions. Extra-high sides and long exit transition help reduce the chance of inadvertent falls. One-piece molded sides do not require on-site assembly of bedway sections and caulking, reducing installation time and future maintenance concerns.

In one embodiment as illustrated in FIG. 1 the sliding board (1) preferably includes an entry area (5) at the upper end (4) of the sliding board (1) and an exit area (8) at the lower end (7) of the slide. When arranged in a normal operating configuration in this embodiment the entry area (5) at the upper end (4) of the sliding board (1) may be, for example, about 96 inches high measured from the ground (11) to the top surface (2) of the sliding board (1) at its upper end (4). The entry area (5) may, for example, be supported by an upper end support (6) such as a ladder or a post or set of posts or a deck that may be part of a larger system.

Figure 5:
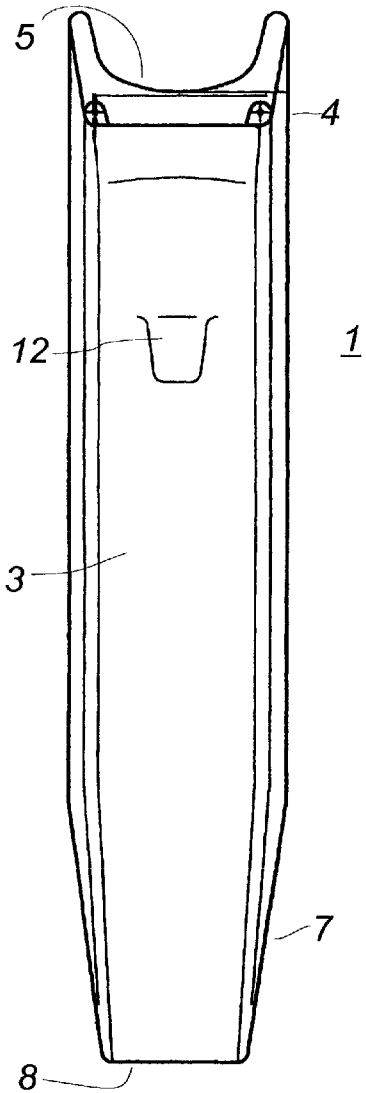
FIG. 5 is a rear orthogonal view if a sliding board such as may be used an practicing the present invention.
Figure 6:
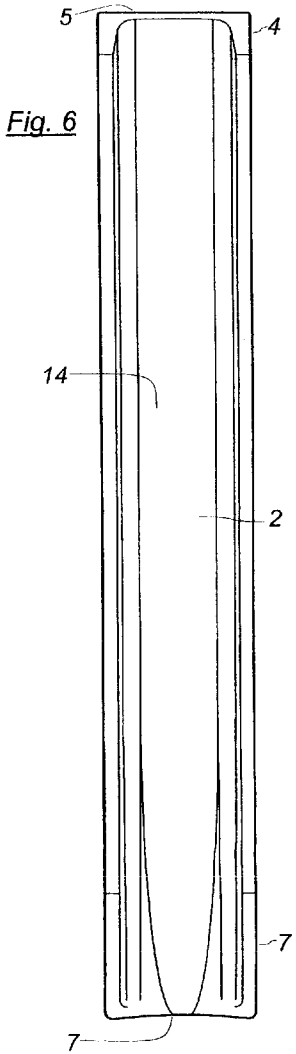
FIG. 6 is a top orthogonal view of a sliding board that may be used in practicing the present invention.
Figure 7:
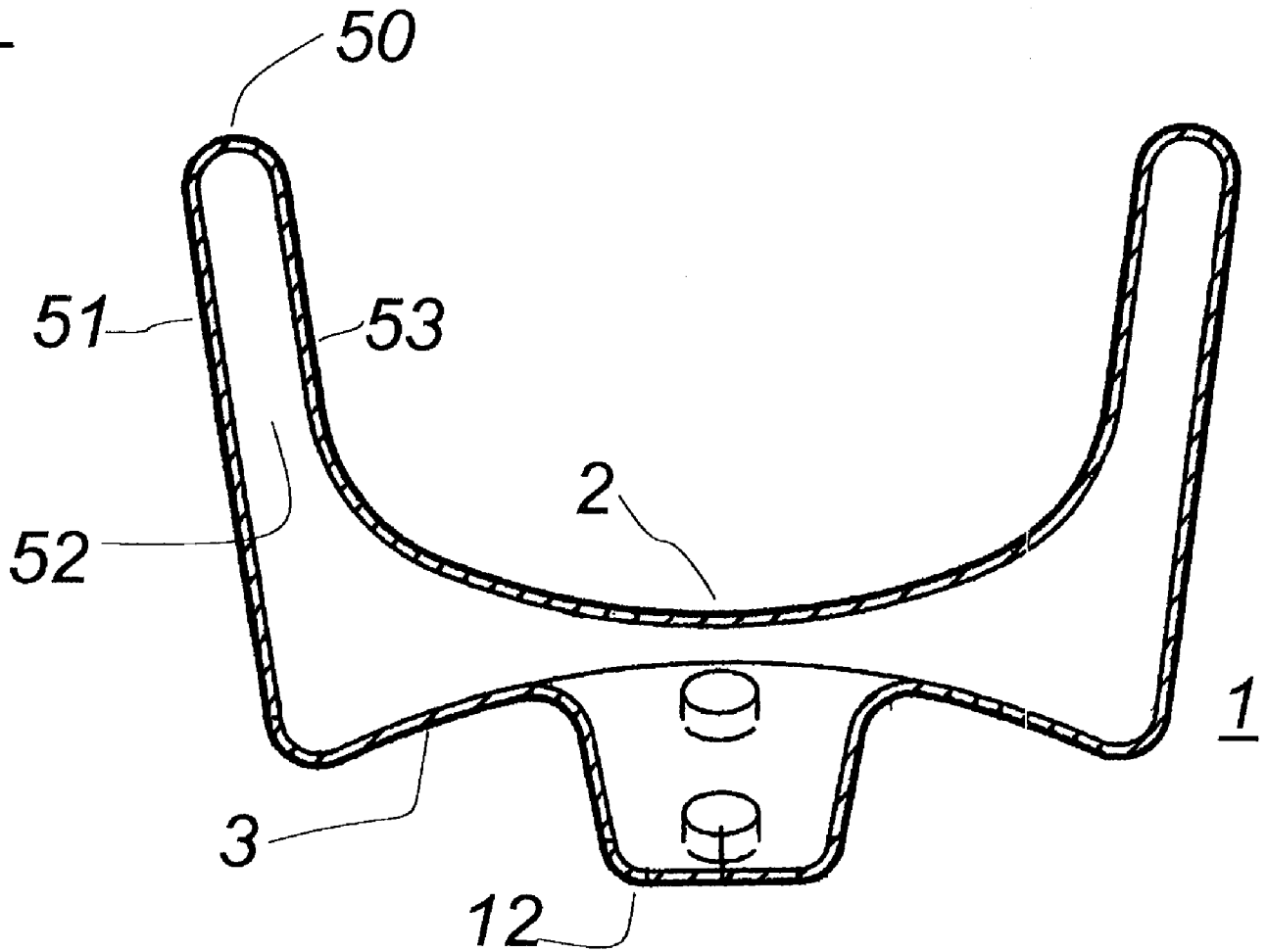
FIG. 7 is a cross-sectional view of a sliding board with a receptacle and an attachment point on the lower surface of the slide for receiving an intermediate support member.

As shown in FIG. 5, the width of the sliding board (1) at its entry area (5) from outside edge (51) to outside edge (51) of the side wall (50) should be sufficient to accommodate the size of the expected user. The top surface (12) and the bottom surface (3) of the sliding board (1) at the entrance of the slide may be separated by a relatively small distance, or may be fused together.

Figure 9:
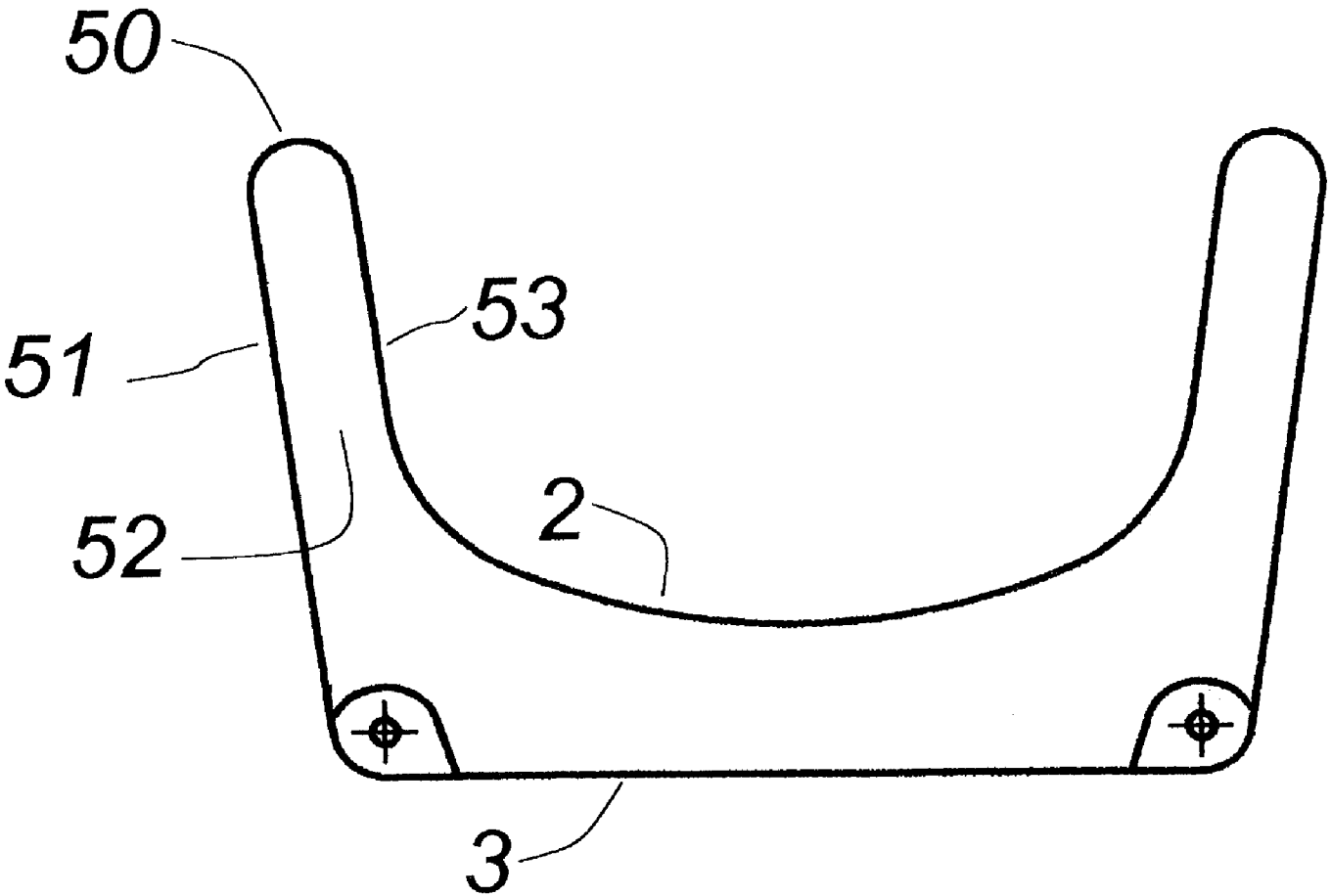
FIG. 9 is an orthogonal view on an entry area at the upper end of a sliding board for use in practicing this present invention.

As shown in FIG. 9, the sliding board (1) preferably includes side walls (50) and may preferably have a concave upper surface (2) curved in cross-section. The width of the slide from center line (52) to center line (52) of the two side walls (50) should be sufficient to accommodate the girth of the expected user. The vertical height of the side wall from the bottom surface of the slide to the top of the side wall should be sufficient to provide support and may be, for example, about two-thirds of the distance from center line (52) to center line (52). The interior surfaces (53) of the side walls (50) preferably angle inwards towards the ground. Because the side walls (56) may angle inwardly towards the ground the distance from center line (52) to center line (52) of the two side walls (50) at their base may be less than at the top. All edges at the entrance to the slide are preferably radiused.

Figure 3:
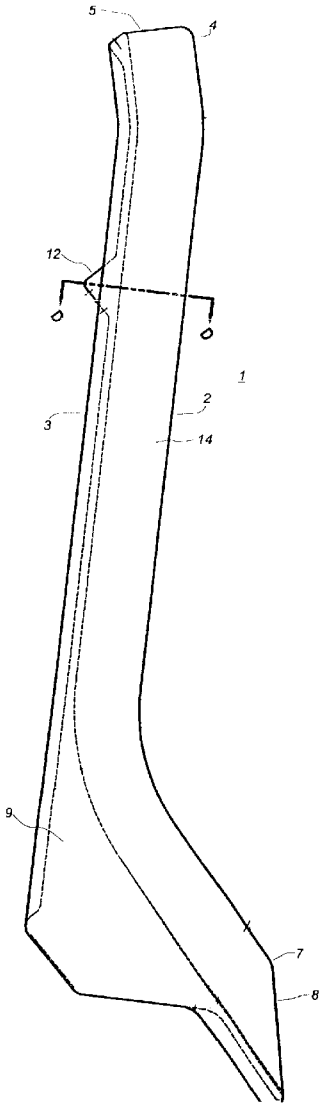
FIG. 3 is a second side view of a sliding board that may be used in practicing the present invention.
Figure 4:
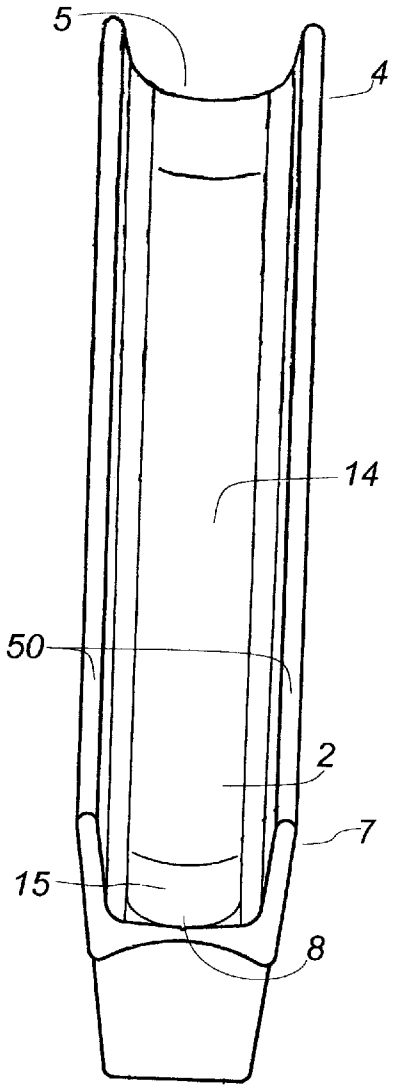
FIG. 4 is a front orthogonal view of a sliding board that may be used in practicing the present invention.

As illustrated in, for example, FIG. 3, a receptacle (12) for receiving an intermediate support (10) may preferably be disposed on the lower surface (3) of the downwardly sloping portion of the chute. The receptacle (12) may receive an additional intermediate support (10) such as a post in the mid section between the entrance area (5) and the exit area (8) of the slide. The point where the receptacle (12) is fixed to the bottom surface (3) of the slide, may preferably be about 80% of the height of the sliding board.

As illustrated in, for example, FIG. 1, the slide may preferably include an intermediate support (10). The intermediate support (10) should be of sufficient height to support the sliding board (1) and may be circular or of any other shape in cross section. The intermediate support (10) may preferably be mounted to a receptacle (12) on the bottom surface (3) of the sliding board (1).

Figure 10:
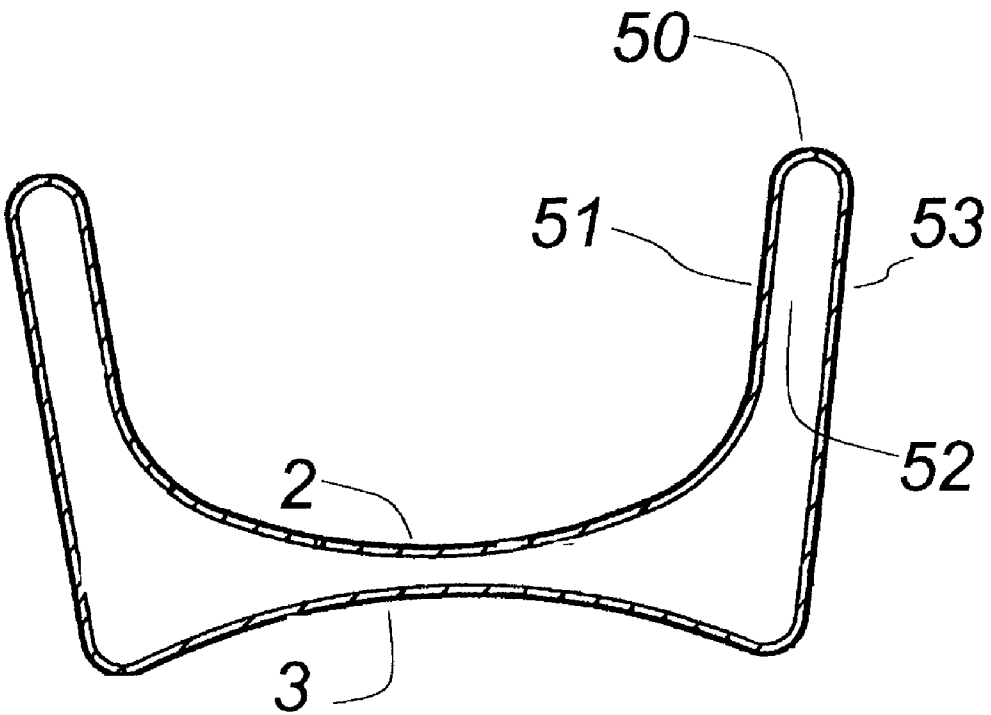
FIG. 10 is a cross-section of a sliding board for use in practicing the present invention taken at a point part-way down the slide other than the attachment point for a support.
Figure 11:
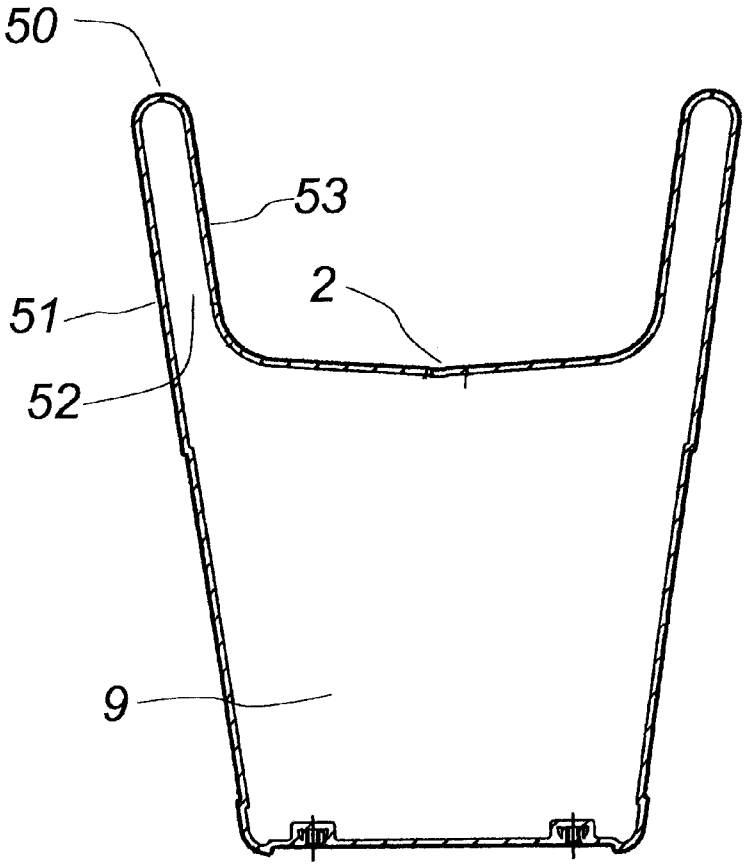
FIG. 11 is a cross-section of a sliding board for use in practicing the present invention taken across the pedestal supporting the lower end of the slide.

As illustrated in FIG. 10, the cross section of the sliding board (1) at a point down about 20% of the vertical height of the slide is downwardly concave on the bottom surface (3) of the sliding board (1). As at entry area (5) of the sliding board (1), the sliding board (1) at this intermediate point will preferably include side walls (50).

Figure 2:
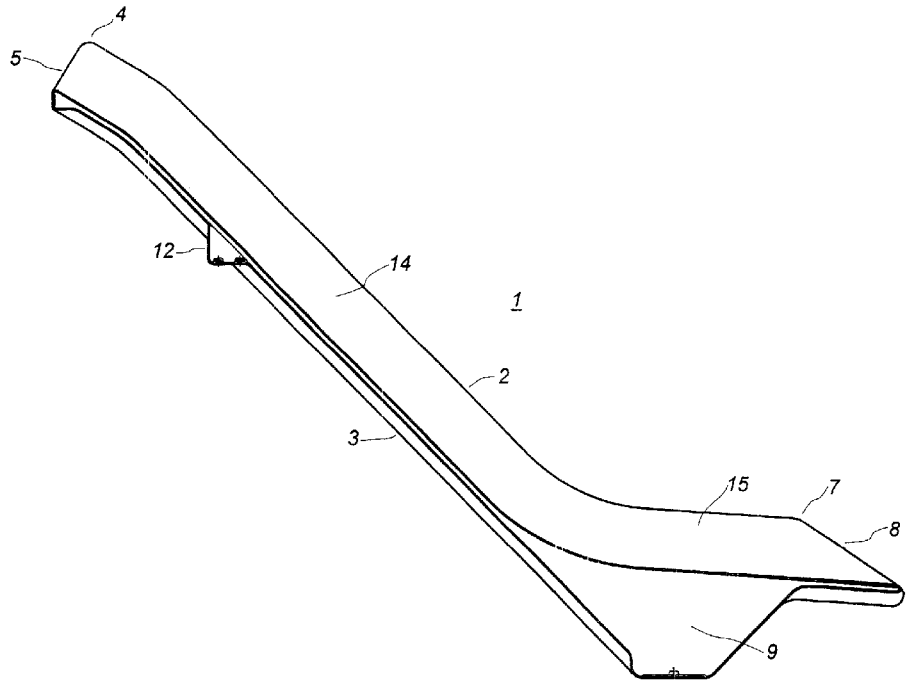
FIG. 2 is a side view of a sliding board that may be used in practicing the present invention.

As illustrated in FIG. 2 in one embodiment the sliding board (1) includes a chute (14) which may slope downwards at an angle of about 45 degrees.

As depicted in FIG. 2 and FIG. 3 in one embodiment, the sliding board (1) preferably includes a run-out (15) at the bottom end (7) of the sliding board (1) in which the upper surface (2) of the sliding board (1) is substantially parallel to the ground (11) when the sliding board (1) is arranged in a normal operating position. The length of the run-out (15) substantially parallel to the ground (11) should be sufficient to provide adequate room for deceleration, as known in the art.

As shown in FIG. 2 and FIG. 3, beneath the part of the slide where the run-out (15) is preferably integrally connected to the sliding board (1) may be a pedestal (9) which may preferably be integrally formed with the other parts of the sliding board (1). The pedestal (9) supports the run-out (15).

Figure 8:
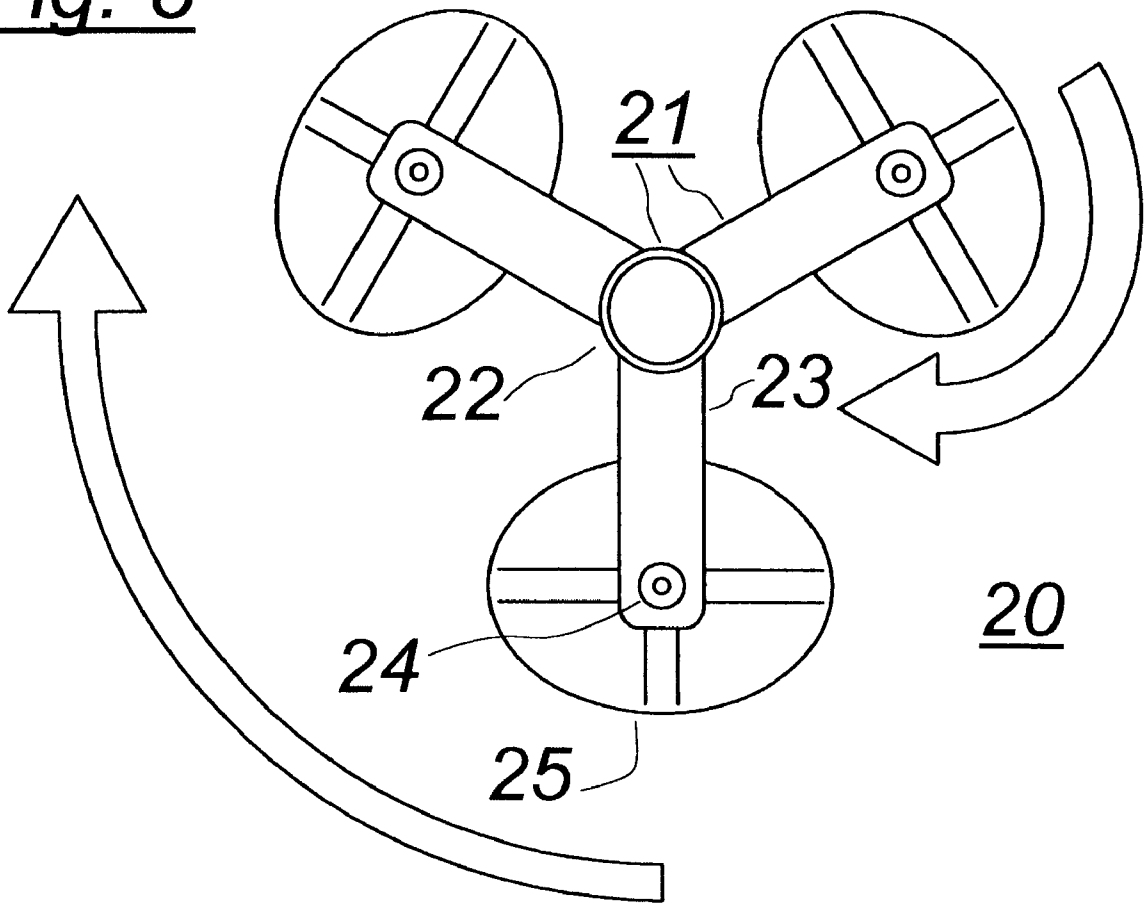
FIG. 8 is a top orthogonal view of a game assembly in accord with the present invention in which the attached play pieces are elliptical in cross section.

As shown in FIG. 1 and FIG. 8, in one embodiment, the game assembly (20) include three canister-shaped appendages (25), each comprising three drum sectional pieces (26). The drum sectional pieces (26) are attached to one another along their respective axes forming an overall canister-shaped appendage (25). The drum sectional pieces (26) and thus the canister-shaped appendage (25) may be of any convenient cross-sectional shape, but are preferably each elliptical in cross section. Viewed together, the canister set of shaped appendages from a circle in cross-section when secured together around the hub. This wider circular cross-section around the intermediate support (10) cushions the said intermediate support (10). Also, the canister-shaped appendages (25) may be made of plastic or similar material and may be of flexible or resilient manufacture capable of providing additional cushioning.

As shown in, for example, FIG. 8 each of the canister-shaped appendage (25) is rotatably mounted along the axis of its constituent drum sectional pieces (26) to an attachment point (24) by means of any well known equivalent conventional means for attaching such as a screw, bolt, rivet, staple, or any other of many well known equivalent means of attachment. The attachment point is on the radially outward end of the arms or spokes (23) attached to the central hub (22) forming the propeller-shaped collar (21) around the intermediate support (10). Each drum sectional piece (26)

has a plurality (preferably 3 or 4) of vertically oriented patterns or images; the drum sectional piece may be rotated along its axis to expose a different image or pattern for each 120°, 90° or 60° rotation, for example. The entire game assembly may also be rotated about its axis to provide a variety of images or patterns for play without movement of the user.

The cylinders disposed around the support positioned intermediately along the bottom of the slide chute may contain one of many patterns known to provide attractive play activities. The panels may contain rotating pictures of, for example, animals such as farm animals or endangered species. The panels may contain rotating pictures of, for example, athletes or working persons in various uniforms. The panels may contain, for example, pictures of planets or items in nature. The pictures on the panels may be selected for educational value or for other purposes. These game pieces, moreover, substantially cover and cushion the pole, protecting those using the playground apparatus from injury.

Although a preferred embodiment has been described above, equivalent variations on this preferred embodiment will be readily apparent to those of ordinary skill in the art and are intended to be encompassed by the claims below. For example, the attachment member may support the game pieces from below rather than from above. The attachment member and game pieces may be attached directly to the ground or the lower surface of the slide with the game pieces still disposed around the support member.

Other variations on the above described embodiments will be apparent to those of ordinary skill in the art. The claims set forth below are therefore not intended to be limited to the preferred embodiment set forth above, but are intended to encompass also a reasonable scope of equivalents.

We claim:

1. A playground slide having an intermediate support, said slide including an upper surface and a lower surface, said slide having an upper-end mounted on an upper end support and a lower end support, said intermediate support member comprising:

at least one post having a base and a top, said top of said post being secured to said lower surface of said playground slide intermediate said upper-end support and said lower end of said slide, said base of said post mounted on the ground, at least one plaything attached to said post, wherein said plaything comprises an attachment member mounted on said post, at least one appendage attached to said attachment member, wherein said attachment member comprises at least one spoke mounted on said hub, for rotation thereabout, and said appendage attached to said spoke.

2. A playground slide having a support member, said playground slide having an upper surface and a lower surface, said support member comprising:

a post having a base and, an attachment member rotatably mounted on said post, said attachment member comprising a hub, at least one spoke radially mounted to said hub at least as far as an attachment point, a plurality of drums each having a plurality of faces, each of said drums being independently rotatable, said top of said post being attached to said lower surface of said playground slide, said base of said post being mounted on the ground, said plurality of drums being attached to said attachment member at the attachment point.

3. The playground slide according to claim 2 wherein said plurality of drums are as a whole substantially circular in cross-section.

4. The playground slide according to claim 2, wherein said plurality of drums contain images adapted for playing a game.

* * * * *